US008383562B2

(12) United States Patent
Jukes

(10) Patent No.: US 8,383,562 B2
(45) Date of Patent: Feb. 26, 2013

(54) SYSTEM OIL FORMULATION FOR MARINE TWO-STROKE ENGINES

(75) Inventor: Ronald Theodorus Fake Jukes, Rotterdam (NL)

(73) Assignee: Chevron Oronite Technology B.V., Rotterdam (NL)

( * ) Notice: Subject to any disclaimer, the term of this patent is extended or adjusted under 35 U.S.C. 154(b) by 136 days.

(21) Appl. No.: 12/585,928

(22) Filed: Sep. 29, 2009

(65) Prior Publication Data

US 2011/0077182 A1 Mar. 31, 2011

(51) Int. Cl.
*C10M 159/22* (2006.01)
*C07C 69/34* (2006.01)
*C10L 1/22* (2006.01)

(52) U.S. Cl. ..... 508/460; 508/465; 508/477

(58) Field of Classification Search ..... 508/460, 508/465, 477
See application file for complete search history.

(56) References Cited

U.S. PATENT DOCUMENTS

| | | | | |
|---|---|---|---|---|
| 5,895,777 | A | 4/1999 | Ueda et al. | |
| 7,163,911 | B2 | 1/2007 | Boons et al. | |
| 2004/0176257 | A1* | 9/2004 | Boffa et al. | 508/156 |
| 2007/0027043 | A1* | 2/2007 | Le Coent | 508/460 |
| 2008/0318818 | A1* | 12/2008 | Mayhew et al. | 508/391 |

FOREIGN PATENT DOCUMENTS

| | | |
|---|---|---|
| EP | 1154012 | 11/2001 |
| EP | 1229101 | 8/2002 |
| EP | 1229102 | 8/2002 |
| EP | 1728849 | 12/2006 |
| EP | 1778824 | 5/2007 |
| GB | 734622 | 8/1955 |
| GB | 738359 | 8/1955 |
| GB | 734598 | 10/1955 |
| GB | 786167 | 11/1957 |
| GB | 1146925 | 3/1969 |

* cited by examiner

*Primary Examiner* — Walter D Griffin
*Assistant Examiner* — Francis C Campanell
(74) *Attorney, Agent, or Firm* — Jones Day

(57) ABSTRACT

In one aspect of the present invention, a marine system oil composition is provided for lubrication of mechanical components in marine engines, for example, two-stroke, cross-head marine diesel engines and methods/additives for using the marine system oil composition in the same. In one aspect of the present invention, a marine system oil composition is provided that has salt of a carboxylate-containing detergent comprising at least one alkyl-substituted hydroxyaromatic carboxylic acid, wherein at least 50 mole % of, the alkyl groups are $C_{20}$ or greater.

26 Claims, No Drawings

SYSTEM OIL FORMULATION FOR MARINE TWO-STROKE ENGINES

The present application relates to marine system oils and methods/additives for the same. In particular, the present application relates to marine system oils for two-stroke, cross-head marine diesel engines, and methods/additives for the same.

BACKGROUND OF THE INVENTION

One type of marine diesel propulsion engine is characterized as a slow speed, two-stroke engine which is frequently referred to as a cross-head engine. In a cross-head engine the firing cylinder and the crankcase are lubricated separately by a cylinder oil and a marine system oil, respectively. A marine system oil lubricates the crankcase of a cross-head marine diesel engine and may cool parts of the engine, especially the undercrown of the pistons. In some engines, the marine system oil also performs the functions of lubricating gears and fuel pumps. Properties that are typically important for systems oils are oxidative stability, viscosity increase control and the detergency of the oil.

The development of ever more sophisticated engines results in an increasing sensitivity to fuel contamination of the lubricating oil, which can lead to undercrown deposit formation in the pistons. As a result, requirements for marine system oils for two-stroke engines become ever more stringent and demanding. Recently new "carboxylate" detergents have been developed, as described in patent application publication U.S. 2007/0027043. The inventors have discovered that such detergent additives, which comprise an overbased salt of at least one alkyl-substituted hydroxyaromatic carboxylic acid wherein at least 50 mole % of alkyl groups are $C_{20}$ or greater, may be used in marine system oils, and that the resultant marine system oils provide superior performance in at least the following areas of oxidation stability, viscosity increase control and detergency than the currently available technology, especially when compared to conventional salicylate-containing detergent technology.

There are numerous overbased detergents and other additives for use in lubricating oils, and the following documents present a few:

U.S. Patent Publication No. 2007/0027043, the entirety of which is hereby incorporated by reference, describes the production of over-based detergents formed by over-basing alkaline earth metal alkylhydroxybenzoates or a mixture of one or more of these with alkylphenols.

U.S. Pat. No. 7,163,911, the entirety of which is hereby incorporated by reference, describes an unsulfurized, single-ring carboxylate-containing additive produced by neutralizing hydrocarbyl phenols using an alkaline earth base in the presence of a promoter, carboxylating the hydrocarbyl phenates using carbon dioxide under carboxylation conditions sufficient to convert at least 20 mole % of the starting hydrocarbyl phenols to hydrocarbyl hydroxybenzoates, and separating at least 10% of the starting hydrocarbyl phenols from the formed product.

U.S. Pat. No. 5,895,777 describes lubricating oil additives comprising the alkaline-earth metal salts of aromatic carboxylic hydroxy acids containing carboxylic acids having 16 to 36 carbon atoms.

European Patent Application No. 1,154,012 describes lubricating compositions comprising an oil, an anti-wear additive and a sole oil-soluble overbased detergent comprising an aromatic carboxylate, such as a calcium salicylate substituted by a hydrocarbon remainder.

British Patent No. 1,146,925 describes lubricating compositions comprising, as lubricating agents, polyvalent metal salts, in particular calcium, and alkylsalicylic acids comprising more than 12, preferably 14 to 18 carbon atoms in the alkyl group. These salts can be prepared from the corresponding sodium salts, as synthesis intermediates.

British Patent No. 786,167 describes polyvalent metal salts of oil-soluble organic acids, such as sulfonic hydrocarbons, naphthenic acids or alkylhydroxybenzoic acids, in particular alkylsalicylic acids having an alkyl radical of up to 22 carbon atoms. The alkylsalicylic acids can be prepared from sodium alkylsalicylic acids according to the processes described in British Patent Nos. 734,598, 734,622 and 738,359. The sodium alkylsalicylates described in these British patents are described as being useful as synthetic intermediates for the preparation of alkaline-earth alkylsalicylates, and useful as additives for lubricating oil.

European Patent Application No. 1,229,101 describes a two-stroke cross-head marine compression-ignited system lubricant, such as diesel engine system lubricant, obtained by admixing a base stock and an oil-soluble overbased metal detergent additive, in a minor amount, in the form of a complex.

European Patent Application No. 1,229,102: A lubricating oil composition comprises an admixture containing: (A) primarily a base stock of lubricating viscosity (base oil); and (B) a minor amount of an oil-soluble over-based metal detergent additive in the form of a complex in which the base material is stabilized by more than one surfactant.

European Patent Application No. 1,728,849 describes a lubrication for a cylinder liner and crankcase in marine diesel crosshead engine that comprises greater than or equal to 40 mass % of an oil of lubricating viscosity, at least one detergent, at least one dispersant, and at least one anti-wear additive.

European Patent Application No. 1,778,824 describes a lubrication for internal combustion engines that comprises selecting an additive package to provide a desired total base number level to the lubricating composition to modify performance characteristics of the engine. The additive package having a viscosity of 2-12 $mm^2/s$ comprising light neutral base oil to form a lubricating composition.

In general, the above references describe overbased detergents and other additives for use in lubricating oils that are not taught for use in the environs where marine system oils are required. Thus, it is desirable to have a marine system oil composition suitable for use, for example, in the crankcase of a slow-speed, two-stroke cross-head marine diesel engine.

SUMMARY OF THE INVENTION

In one aspect of the present invention, a marine system oil composition is provided for lubrication of mechanical components in marine engines, for example, two-stroke, cross-head marine diesel engines and methods/additives for using the marine system oil composition in the same.

In one aspect of the present invention, a marine system oil composition is provided that has a carboxylate-containing detergent.

In another aspect of the present invention, a marine system oil composition is provided that has a carboxylate-containing detergent, wherein the system oil composition has a TBN in a range of between 3.5 and 20.

In another aspect of the present invention, a marine system oil composition is provided that has a carboxylate-containing detergent wherein the detergent comprises a salt of at least one alkyl-substituted hydroxyaromatic carboxylic acid wherein at least 50 mole % of the alkyl groups are $C_{20}$ or greater, and the system oil composition has a TBN in a range of between 3.5 and 20.

In another aspect of the present invention, a marine system oil composition is provided that has a major amount of a base oil of lubricating viscosity, and a minor amount of a carboxylate-containing detergent having a TBN in the range of between 100 and 450, and the system oil composition has a TBN in a range of between 3.5 and 20.

In another aspect of the present invention, a marine system oil composition is provided that has an overbased salt of a carboxylate-containing detergent.

In another aspect of the present invention, a marine system oil composition is provided that has an overbased metal salt of a carboxylate-containing detergent.

In another aspect of the present invention, a marine system oil composition is provided that has an overbased metal salt of a carboxylate-containing detergent and a neutral salt of a carboxylate-containing detergent.

In another aspect of the present invention, a marine system oil composition is provided that has a metal salt of a carboxylate-containing detergent, wherein the metal is an alkaline earth metal.

In another aspect of the present invention, a marine system oil composition is provided that has an overbased metal salt of a carboxylate-containing detergent, wherein the metal is an alkaline earth metal.

In another aspect of the present invention, a marine system oil composition is provided that has a salt of at least one alkyl-substituted hydroxyaromatic carboxylic acid, wherein the salt of at least one alkyl-substituted hydroxyaromatic carboxylic acid is not overbased.

In another aspect of the present invention, a marine system oil composition is provided that has a carboxylate-containing detergent, wherein the carboxylate-containing detergent is a non-overbased carboxylate-containing detergent.

In another aspect of the present invention, a marine system oil composition is provided that has a metal salt of a carboxylate-containing detergent, comprising at least one metal salt of at least one alkyl-substituted hydroxyaromatic carboxylic acid, wherein the at least one alkyl-substituted hydroxyaromatic carboxylic acid is at least one alkyl-substituted hydroxybenzoic acid, also referred to as an alkylhydroxybenzoic acid.

In another aspect of the present invention, a marine system oil composition is provided that has an overbased metal salt of a carboxylate-containing detergent that is prepared by overbasing at least one alkyl-substituted hydroxyaromatic carboxylic acid detergent.

In another aspect of the present invention, a marine system oil composition is provided that has an overbased metal salt of a carboxylate-containing detergent that is prepared by overbasing a salt of at least one alkyl-substituted hydroxyaromatic carboxylic acid detergent.

In another aspect of the present invention, a marine system oil composition is provided that has an overbased metal salt of a carboxylate-containing detergent that is prepared by overbasing a metal salt of a carboxylate-containing detergent.

In another aspect of the present invention, a marine system oil composition is provided that has a carboxylate-containing detergent comprising the salt of at least one alkyl-substituted hydroxyaromatic carboxylic acid prepared by the process comprising reacting a mixture containing at least one alkyl-substituted hydroxyaromatic carboxylic acid, wherein at least 50 mole % of the alkyl groups on the at least one alkyl-substituted hydroxyaromatic carboxylic acid are $C_{20}$ or greater, and a base.

In another aspect of the present invention, a marine system oil composition is provided that has a carboxylate-containing detergent comprising the salt of at least one alkyl-substituted hydroxyaromatic carboxylic acid prepared by the process comprising reacting a mixture containing at least one alkyl-substituted hydroxyaromatic carboxylic acid, wherein at least 50 mole % of the alkyl groups on the at least one alkyl-substituted hydroxyaromatic carboxylic acid are $C_{20}$ or greater, and a base, is further reacted with at least one overbasing compound in the presence of a further base, to provide an overbased salt of the at least one alkyl-substituted hydroxyaromatic carboxylic acid.

In another aspect of the present invention, a marine system oil composition is provided that has a carboxylate-containing detergent comprising the salt of at least one alkyl-substituted hydroxyaromatic carboxylic acid prepared by the process comprising reacting a mixture containing at least one alkyl-substituted hydroxyaromatic carboxylic acid, wherein at least 50 mole % of the alkyl groups on the at least one alkyl-substituted hydroxyaromatic carboxylic acid are $C_{20}$ or greater, a base, and at least one overbasing compound, to thereby provide an overbased salt of the at least one alkyl-substituted hydroxyaromatic carboxylic acid.

In another aspect of the present invention, a marine system oil composition is provided that has a carboxylate-containing detergent comprising the salt of at least one alkyl-substituted hydroxyaromatic carboxylic acid prepared by the process comprising reacting a mixture containing at least one alkyl-substituted hydroxyaromatic carboxylic acid, wherein at least 50 mole % of the alkyl groups on the at least one alkyl-substituted hydroxyaromatic carboxylic acid are $C_{20}$ or greater, and a base, is further reacted with at least one overbasing compound in the presence of a further base, to provide an overbased salt of the at least one alkyl-substituted hydroxyaromatic carboxylic acid, wherein the base and the further base are the same base.

In another aspect of the present invention, a marine system oil composition is provided that has an overbased metal salt of a carboxylate-containing detergent that is prepared by overbasing a salt of at least one alkyl-substituted hydroxyaromatic carboxylic acid detergent or a mixture of the at least one alkyl-substituted hydroxyaromatic carboxylic acid and up to 50 mole % of alkylphenol, based on the total amount of detergent.

In another aspect of the present invention, a marine system oil composition is provided that has an overbased metal salt of a carboxylate-containing detergent that is prepared by overbasing at least one alkyl-substituted hydroxyaromatic carboxylic acid with a molar excess of a metal base and at least one acidic overbasing material in the presence of at least one carboxylic acid having from one to four carbon atoms, wherein the metal base is an alkaline earth metal base.

In another aspect of the present invention, a marine system oil composition is provided that has an overbased metal salt of a carboxylate-containing detergent that is prepared by overbasing a salt of a carboxylate-containing detergent with a molar excess of a metal base and at least one acidic overbasing material in the presence of at least one carboxylic acid having from one to four carbon atoms, wherein the metal base is an alkaline earth metal base, for example calcium hydroxide.

In another aspect of the present invention, a marine system oil composition is provided that has an overbased metal salt of a carboxylate-containing detergent that is prepared by overbasing a metal salt of a carboxylate-containing detergent with a molar excess of a metal base and at least one acidic overbasing material in the presence of at least one carboxylic acid having from one to four carbon atoms, wherein the metal base is an alkaline earth metal base.

In another aspect of the present invention, a marine system oil composition is provided that has an overbased metal salt of a carboxylate-containing detergent that is prepared by overbasing a metal salt of a carboxylate-containing detergent with a molar excess of a metal base and at least one acidic overbasing material in the presence of at least one carboxylic acid having from one to four carbon atoms, wherein the metal base is calcium hydroxide.

In another aspect of the present invention, a marine system oil composition is provided that has an overbased metal salt of a carboxylate-containing detergent, comprising an overbased alkaline earth metal salt of at least one alkyl-substituted hydroxyaromatic carboxylic acid, wherein the alkaline earth metal is calcium or magnesium and the alkyl groups on the at least one alkyl-substituted hydroxyaromatic carboxylic acid comprise at least 50 mole % of alkyl groups having 20 carbon atoms or greater (that are a linear or branched alkyl or a mixture of linear and branched alkyl groups).

In another aspect of the present invention, a marine system oil composition is provided that has an overbased alkaline earth metal salt of a carboxylate-containing detergent, wherein the overbased alkaline earth metal salt of a carboxylate-containing detergent is the product of reacting an overbasing compound with a salt of at least one alkyl-substituted hydroxyaromatic carboxylic acid, wherein the salt of at least one alkylhydroxyaromatic carboxylic acid comprises a compound or mixture of compounds represented by the structure of Formula (I):

Formula (I)

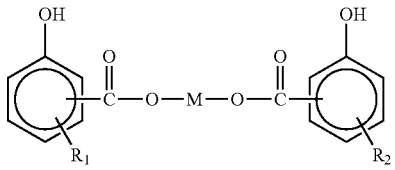

wherein i) M independently represents an alkaline earth metal, for example, magnesium, calcium, barium, and strontium; and ii) $R_1$ and $R_2$ each independently represents a linear and/or branched alkyl group, wherein at least 50 mole % of the alkyl groups are $C_{20}$ or greater.

In another aspect of the present invention, a marine system oil composition is provided that has an overbased alkaline earth metal salt of a carboxylate-containing detergent, wherein the overbased alkaline earth metal salt of a carboxylate-containing detergent comprises a compound or mixture of compounds represented by Formula (I) wherein at least 50 mole % of the alkyl groups are $C_{20}$ or greater.

In another aspect of the present invention, a marine system oil composition is provided that has a metal salt of a carboxylate-containing detergent, comprising an alkali metal salt of at least one alkyl-substituted hydroxyaromatic carboxylic acid, wherein the alkali metal is lithium, sodium, or potassium.

In another aspect of the present invention, a marine system oil composition is provided that has a carboxylate-containing detergent, wherein the system oil composition viscosity index is greater than 90.

In another aspect of the present invention, a marine system oil composition is provided that has a carboxylate-containing detergent, wherein the system oil composition viscosity is less than 19 cSt at 100° C., less than 138 cSt at 40° C., and/or a SAE viscosity grade of less than or equal to 40.

In another aspect of the present invention, a marine system oil composition is provided that has a carboxylate-containing detergent, wherein the system oil composition flash point (closed cup) is greater than 220° C.

In another aspect of the present invention, a marine system oil composition is provided that has a carboxylate-containing detergent, wherein the system oil composition pour point is less than −12° C.

In another aspect of the present invention, a marine system oil composition is provided that has a carboxylate-containing detergent, wherein the carboxylate-containing detergent is the sole overbased metal detergent.

In another aspect of the present invention, a marine system oil composition is provided that has an overbased metal salt of a carboxylate-containing detergent, wherein the overbased metal salt of a carboxylate-containing detergent is the sole overbased metal detergent.

In another aspect of the present invention, a marine system oil composition for use as a marine system oil in operating a slow speed two-stroke cross-head marine diesel engine is provided that contains a carboxylate-containing detergent.

In another aspect of the present invention, a marine system oil additive package or concentrate for use in a marine system oil composition is provided comprising a major amount of a base oil of lubricating viscosity, and a minor amount of a carboxylate-containing detergent, wherein the carboxylate-containing detergent has a TBN in the range of between 100 and 450.

In another aspect of the present invention, a marine system oil additive package or concentrate for use in a marine system oil composition is provided comprising a major amount of a base oil of lubricating viscosity, and a minor amount of an overbased metal salt of a carboxylate-containing detergent, wherein the overbased metal salt of the carboxylate-containing detergent has a TBN in the range of between 100 and 450.

In another aspect of the present invention, a method of operating a two-stroke cross-head marine diesel engine is provided that has a marine system oil composition comprising a major amount of a base oil of lubricating viscosity, and a minor amount of a carboxylate-containing detergent, wherein the system oil composition has a TBN in the range of between 3.5 and 20.

In another aspect of the present invention, a method of cooling an undercrown of a piston in the operating of a two-stroke cross-head marine diesel engine is provided that has a marine system oil composition comprising a major amount of a base oil of lubricating viscosity, and a minor amount of a carboxylate-containing detergent, wherein the system oil composition has a TBN in the range of between 3.5 and 20.

In another aspect of the present invention, a method of providing lubrication of a crankcase in the operating of a two-stroke cross-head marine diesel engine is provided that has a marine system oil composition comprising a major amount of a base oil of lubricating viscosity, and a minor amount of a carboxylate-containing detergent, wherein the detergent comprises at least one alkyl hydroxyaromatic carboxylic acid wherein at least 50 mole % of the alkyl groups are $C_{20}$ or greater In another aspect of the present invention, a method of improving oxidation control and/or stability of a marine system oil composition having a TBN in the range of between 3.5 and 20 by adding a carboxylate-containing detergent.

In another aspect of the present invention, a method of improving corrosion protection of a marine system oil composition having a TBN in the range of between 3.5 and 20 by adding a carboxylate-containing detergent.

In another aspect of the present invention, a method of improving viscosity increase control of a marine system oil composition having a TBN in the range of between 3.5 and 20 by adding a carboxylate-containing detergent.

In another aspect of the present invention, a marine system oil composition that provides superior performance in one or more of the areas of oxidation stability, viscosity increase control or detergency than the currently available technology, especially when compared to conventional salicylate-containing detergent technology is provided, comprising a major amount of a base oil of lubricating viscosity, and a minor amount of a carboxylate-containing detergent, wherein the system oil composition has a TBN in the range of between 3.5 and 20.

In other embodiments, a method of operating a slow speed two-stroke cross-head marine diesel engine, comprises providing superior performance in one or more of the areas of oxidation stability, viscosity increase control and/or detergency than the currently available technology, especially when compared to conventional salicylate-containing detergent technology, by providing a marine system oil containing a carboxylate-containing detergent.

In another aspect of the present invention, a marine system oil composition comprising a carboxylate-containing detergent has a TBN in the range of between 3.5 and 20, wherein the detergent comprises at least one alkyl-substituted hydroxyaromatic carboxylic acid wherein at least 50 mole % of the alkyl groups are $C_{20}$ or greater, and wherein said marine system oil composition provides superior performance in one or more of the areas of oxidation stability, viscosity increase control or detergency than the currently available technology, especially when compared to conventional salicylate-containing detergent technology.

In another aspect of the present invention, a marine system oil composition that provides superior performance in one or more of the areas of oxidation stability, viscosity increase control or detergency than the currently available technology, especially when compared to conventional salicylate-containing detergent technology is provided, comprising a major amount of a base oil of lubricating viscosity, and a minor amount of an overbased metal salt of a carboxylate-containing detergent, wherein the system oil composition has a TBN in the range of between 3.5 and 20, and wherein the detergent comprises at least one alkyl-substituted hydroxyaromatic carboxylic acid wherein at least 50 mole % of the alkyl groups are $C_{20}$ or greater.

DETAILED DESCRIPTION OF THE INVENTION

The definitions that follow are intended to provide the meaning of the term as used throughout the application (including claims) unless expressly stated otherwise.

DEFINITIONS

The term "alkylphenol" means a phenol having one or more alkyl substituents, wherein at least one of the alkyl substituents has a sufficient number of carbon atoms to impart oil solubility to the phenol.

The term "marine system oil" means a lubricating oil composition which lubricates the crankcase of a slow speed, two-stroke cross-head marine diesel propulsion engine and may cool parts of the engine, especially the undercrown of the pistons. In a cross-head engine, the firing cylinder and the crankcase are lubricated separately by a cylinder oil and a marine system oil, respectively. A marine system oil composition may have, for example, a TBN in the range of between 3.5 and 20.

The term "base oil" as used herein is defined as a base stock or blend of base stocks inclusive of natural, synthetic, unrefined, refined and rerefined stocks. The base oil employed may be any of a wide variety of oils of lubricating viscosity. The base oil of lubricating viscosity used in such compositions may be derived from natural lubricating oils, synthetic oils, or mixtures thereof. For example, suitable base oils may include those having a viscosity of at least about 4 cSt at 100° C., such as a kinematic viscosity at 100° C. of about 4 centistokes (cSt) to about 20 cSt. and/or a pour point below 20° C., preferably at or below 0° C., is desirable.

Natural lubricating oils may include animal oils, vegetable oils (e.g., rapeseed oils, castor oils and lard oil), petroleum oils, mineral oils, and oils derived from coal or shale. Mineral oils for use as the base oil in this invention include, for example, paraffinic, naphthenic and other oils that are ordinarily used in lubricating oil compositions.

The term "detergent" is an oil-soluble surfactant, such as, for example, an organic acid that includes at least one relatively low molecular weight non-polar tail (relatively low compared to dispersants) and a polar head. Suitable detergents, for example, can be "neutral" detergents or "overbased" detergents. The molecular weight of the non-polar tail must be large enough to make the surfactant oil-soluble or the resulting detergent oil-soluble and compatible with other additives. Typically the molecular weight of the non-polar tail can be at least 120 Daltons (i.e., about $C_9$); for example at least about 150 Daltons (i.e., about $C_{12}$); at least about 220 Daltons (i.e., about $C_{16}$); or less than about 560 Daltons ($C_{40}$). The tail is generally a hydrocarbon, and can be linear or branched or a mixture of linear and branched. The tail may, for example, be derived from an olefinic compound, such as an oligomer of ethylene, propylene or butylene or a mixture of olefinic monomers, or can be derived from another source, such as olefins derived from the thermal cracking of wax. Alternatively, the non-polar portion may be derived from an aromatic lubricating oil basestock. The polar head of the surfactant may be, for example, any polar moiety which forms a salt with a metal. For example, polar moieties may include sulfonic acid groups, for example aryl sulfonic acid groups; hydroxyaromatic groups, for example phenolic groups; hydroxyaromatic aromatic carboxylic acid groups, for example hydroxyaromatic benzoic acid groups, and carboxylic acid groups, which can be supplied from, for example, a fatty acid, a naphthenic acid, or a petroleum oxidate.

The terms "conventional salicylate-containing detergent" and "salicylate-containing detergent" refer to an alkyl-substituted hydroxyaromatic carboxylic acid detergent comprising the salt of an alkyl-substituted hydroxyaromatic carboxylic acid, wherein at least 50 mole % of the alkyl groups are $C_{14-18}$ or less.

The term "carboxylate-containing detergent" refers to an alkyl-substituted hydroxyaromatic carboxylic acid detergent comprising the salt of an alkyl-substituted hydroxyaromatic carboxylic acid, wherein at least 50 mole % of the alkyl groups are $C_{20}$ or greater. Preferred alkyl-substituted hydroxyaromatic carboxylic acids include alkyl-substituted hydroxybenzoic acids. Salts of such alkyl-substituted hydroxyaromatic carboxylic acids and alkyl-substituted hydroxybenzoic acids are referred to as alkyl-substituted hydroxyaromatic carboxylates and alkyl-substituted hydroxybenzoates, respectively.

For example, the carboxylate-containing detergent comprises the salt of at least one alkyl-substituted hydroxyaromatic carboxylic acid, wherein the detergent comprises at least one alkyl-substituted hydroxyaromatic carboxylic acid wherein at least 50 mole % of the alkyl groups are $C_{20}$ or greater, for example, at least 60 mole %, at least 70 mole %, at least 80 mole %, at least 90 mole %, at least 95 mole %, at least 96 mole %, at least 97 mole %, at least 98 mole %, or at least 99 mole %, and even where all the detergent comprises the salt of at least one alkyl-substituted hydroxyaromatic carboxylic acids, wherein 100 mole % of the alkyl groups are $C_{20}$ or greater. The alkyl groups of the at least one alkyl-substituted hydroxyaromatic carboxylic acids may contain linear groups, branched groups, or a mixture of linear and branched groups. The linear alkyl groups, may be, for example, a mixture of linear alkyl groups selected from the group consisting of $C_{20}$-$C_{22}$, $C_{20}$-$C_{24}$, $C_{20}$-$C_{28}$, $C_{20}$-$C_{30}$ and/or $C_{20}$-$C_{36}$ alkyl and mixtures thereof, derived for example from normal alpha olefins.

The term "metal salt of a carboxylate-containing detergent" refers to metal salts of the above mentioned carboxylate-containing detergent, wherein the metal may be an alkali metal or an alkaline earth metal, for example, an alkali metal salt of a carboxylate-containing detergent or an alkaline earth metal salt of a carboxylate-containing detergent. Suitable alkali metal or an alkaline earth metals can be provided from the corresponding metal hydroxides. For example, sodium hydroxide and potassium hydroxide provide the source for the alkali metals sodium and potassium, respectively, while calcium hydroxide and magnesium hydroxide provide the source for the alkaline earth metals calcium and magnesium, respectively.

The term "overbased" refers to a process by which the resulting metal content present in a metal salt of a carboxylate-containing detergent composition is in excess of the stoichiometric amount required to neutralize the carboxylic acid. Suitable overbasing metals include alkaline earth metals such as magnesium, calcium, barium, and strontium. Suitable overbasing metals can be provided from the corresponding metal hydroxides, for example, calcium hydroxide and magnesium hydroxide provide the source for the alkaline earth metals calcium and magnesium, respectively. Additional overbasing can be achieved by the addition of acidic overbasing compounds for example, carbon dioxide and boric acid. An overbased metal salt of a carboxylate-containing detergent may include those having an elevated TBN, for example, those having a TBN of greater than 100, for example between 100 and 450.

The "soap content" of a marine system oil composition refers to the concentration of surfactant that is contributed to the formulation by one or more detergents within the composition. For example, a suitable soap content for a marine system oil composition in one aspect of the present invention may be greater than 6 millimoles surfactant/kg system oil composition (mmol/kg); for example greater than 7 mmol/kg; greater than 8 mmol/kg; 9 mmol/kg or 10 mmol/kg. The soap content may be achieved by means of a single detergent, or by a mixture of detergents. For example, the soap content may be achieved solely with a metal salt of a carboxylate-containing detergent, a neutral metal salt of a carboxylate-containing detergent, or an overbased metal salt of a carboxylate-containing detergent, or mixtures thereof, or with a mixture of a metal salt, a neutral metal salt, or an overbased metal salt of a carboxylate-containing detergent and other detergents.

The term "Total Base Number" or "TBN" refers to the level of alkalinity in an oil sample, which indicates the ability of the composition to continue to neutralize corrosive acids, in accordance with ASTM D2896. The test measures the change in electrical conductivity, and the results are expressed as mgKOH/g (the equivalent number of milligrams of KOH needed to neutralize 1 gram of a product). Therefore, a high TBN reflects strongly overbased products and, as a result, a higher base reserve for neutralizing acids. The TBN of a product can be determined by ASTM Standard No. D2896 or equivalent procedure.

Marine System Oil Composition

The present invention provides marine system oil compositions and methods for using said compositions in marine diesel engines, for example, two-stroke cross-head marine diesel engines. In one aspect of the invention, a marine system oil composition is provided that comprises a major amount of a base oil of lubricating viscosity, and a minor amount of a salt of a carboxylate-containing detergent. The marine system oil composition may have, for example, a TBN in the range of between 3.5 and 20, for example, in the range of between 3.5 and 18, between 3.5 and 14, between 3.5 and 10, between 3.5 and 9, between 3.5 and 7, between 3.5 and 6, between 3.5 and 5, between 4 and 16, between 4 and 12, between 4 and 10, between 4 and 8, between 4 and 7, between 4 and 6, between 4 and 5, between 4.5 and 15, between 5 and 13, between 5 and 9, between 5 and 8, between 5 and 7, between 5.5 and 11, between 6 and 10, between 7 and 12, or between 10 and 20.

Suitable base oil of lubricating viscosity include Group I or Group II or a blend of Group I oils or Group II oils or mixtures of Group I oils (inclusive of blends) and Group II oils (inclusive of blends). In some embodiments the base oil may be present in an amount of between 40 wt. % and 97 wt. %, for example, at least 40 wt. %, at least 45 wt. %, 50 wt. %, 55 wt. %, 60 wt. %, 65 wt. %, 70 wt. %, 75 wt. %, 80 wt. %, 85 wt. %, or at least 90 wt. % (weight percent refers to weight percent of the base oil relative to the total weight of the system oil composition.)

Base Oils

Suitable base oils include those in the *API categories I and II as defined in API* Publication 1509, 14th Edition, Addendum I, December 1998. (Table I provides a summary of the characteristics for Groups I-V base oils).

TABLE 1

| Group | Saturates (as determined by ASTM D 2007) | Sulfur (as determined by ASTM D 2270) | Viscosity Index (as determined by ASTM D 4294, ASTM D 4297 or ASTM D 3120) |
|---|---|---|---|
| I | Less than 90% saturates. | Greater than or equal to 0.03% sulfur. | Greater than or equal to 80 and less than 120. |
| II | Greater than or equal to 90% saturates. | Less than or equal to 0.03% sulfur. | Greater than or equal to 80 and less than 120. |
| III | Greater than or equal to 90% saturates. | Less than or equal to 0.03% sulfur. | Greater than or equal to 120. |
| IV | Defined as polyalphaolefins (PAO) | | |

TABLE 1-continued

| Group | Saturates (as determined by ASTM D 2007) | Sulfur (as determined by ASTM D 2270) | Viscosity Index (as determined by ASTM D 4294, ASTM D 4297 or ASTM D 3120) |
|---|---|---|---|
| V | All other base stocks not included in Groups I, II, III or IV | | |

Group I base oils can comprise light overhead cuts and heavier side cuts from a vacuum distillation column and can also include, for example, Light Neutral, Medium Neutral, and Heavy Neutral base stocks. The petroleum derived base oil also may include residual stocks or bottoms fractions, such as, for example, bright stock. Suitable Group I base stocks may include, for example, ExxonMobil CORE® 100, ExxonMobil CORE® 150, ExxonMobil CORE® 600, and ExxonMobil CORE® 2500, base stocks.

Suitable Group II base stocks may include, for example, Chevron 100R, 220R, 600R and 5R Group II base stocks, available from Chevron Products Co. (San Ramon, Calif.).

In one embodiment, the base oil can be a blend or mixture of two or more, three or more, or even four or more base stocks having different molecular weights and viscosities, wherein the blend is processed in any suitable manner to create a base oil having suitable properties.

Base stocks may be manufactured using a variety of different processes including but not limited to distillation, solvent refining, hydrogen processing, oligomerization, esterification, and rerefining. Examples of suitable base oils may include those derived from unrefined, refined, rerefined oils, or mixtures thereof.

Unrefined oils are obtained directly from a natural source or synthetic source (e.g., coal, shale, or tar sand bitumen) without further purification or treatment. Examples of unrefined oils include shale oils obtained directly from a retorting operation, petroleum oils obtained directly from distillation, and/or an oils obtained directly from an esterification process, each of which may then be used without further treatment.

Refined oils are similar to the unrefined oils except that refined oils have been treated in one or more purification steps to improve one or more properties. Suitable purification techniques include distillation, hydrocracking, hydrotreating, dewaxing, solvent extraction, acid or base extraction, filtration, and percolation, all of which are known to those skilled in the art.

Rerefined oils may be obtained by treating used oils in processes similar to those used to obtain the refined oils. Rerefined oils are also known as reclaimed or reprocessed oils and often are additionally processed by techniques for removal of spent additives and oil breakdown products.

Suitable base oil includes base stocks obtained by isomerization of synthetic wax and slack wax, as well as hydrocrackate base stocks produced by hydrocracking (rather than solvent extracting) the aromatic and polar components of the crude. Examples of base oils may include those derived from the hydroisomerization of wax, either alone or in combination with the aforesaid natural and/or synthetic base oil. Such wax isomerate oil is produced by the hydroisomerization of natural or synthetic waxes or mixtures thereof over a hydroisomerization catalyst. The base oil can be refined paraffin type base oils, a refined naphthenic base oils, synthetic hydrocarbon oils and/or non-hydrocarbon oils of lubricating viscosity. The base oil may also be a mixture of natural and synthetic oils.

Suitable synthetic oils include, for example, hydrocarbon synthetic oils, synthetic esters, silicon-based oils and halo-substituted hydrocarbon oils such as polymerized and interpolymerized olefins, alkylbenzenes, polyphenyls, alkylated diphenyl ethers, alkylated diphenyl sulfides, as well as their derivatives, analogues and homologues thereof, and mixtures thereof having the desired viscosity.

Suitable hydrocarbon synthetic oils may include, for example, oils prepared from the polymerization of ethylene, polyalphaolefin or PAO oils, or oils prepared from hydrocarbon synthesis procedures using carbon monoxide and hydrogen gases such as in a Fisher Tropsch process. Synthetic lubricating oils also include alkylene oxide polymers, interpolymers, copolymers and derivatives thereof wherein the terminal hydroxyl groups have been modified by esterification, etherification, etc. Synthetic hydrocarbon oils may include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used.

Suitable synthetic esters may include the esters of monocarboxylic acids and polycarboxylic acids, as well as mono hydroxy alkanols and polyols. Typical examples are didodecyl adipate, pentaerythritol tetracaproate, di-2-ethylhexyl adipate, dilaurylsebacate, and the like. Further examples of suitable mono hydroxy alkanol and polyol synthetic ester oils may include those made from $C_5$ to $C_{12}$ monocarboxylic acids and polyols and polyol ethers. Tri-alkyl phosphate ester oils such as those exemplified by tri-n-butyl phosphate and tri-iso-butyl phosphate are also suitable for use as base oils. Complex esters prepared from mixtures of mono and dicarboxylic acids and mono and dihydroxy alkanols can also be used. Blends of mineral oils with synthetic oils are also useful.

Suitable silicon-based oils include, for example, the polyalkyl-, polyaryl-, polyalkoxy-, or polyaryloxy-siloxane oils and silicate oils. Other synthetic lubricating oils include liquid esters of phosphorus-containing acids, polymeric tetrahydrofurans, polyalphaolefins, and the like.

Carboxylate-Containing Detergents

Some suitable overbased metal salts of carboxylate-containing detergents useful in the present invention may include overbased alkaline earth metal salts of carboxylate-containing detergents.

Some examples of suitable overbased metal salts of carboxylate-containing detergents that may be useful in the present invention are those that comprise the salt of at least one alkyl-substituted hydroxyaromatic carboxylic acid, wherein at least 50 mole % of the alkyl groups are $C_{20}$ or greater, for example, at least 60 mole %, at least 65 mole %, at least 70 mole %, at least 75 mole %, at least 80 mole %, at least 85 mole %, at least 90 mole %, or at least 95 mole %, at least 96 mole %, at least 97 mole %, at least 98 mole %, at least 99 mole %, or 100 mole % of the alkyl groups are $C_{20}$ or greater. The overbased metal salt of a carboxylate-containing detergent may also comprise at least 50 mole % of the amount of detergent, relative to the total amount of detergent present, for example, at least 60 mole %, at least 65 mole %, at least 70 mole %, at least 75 mole %, at least 80 mole %, at least 85 mole %, at least 90 mole %, or at least 95 mole %, at least 96 mole %, at least 97 mole %, at least 98 mole %, at least 99 mole %, or 100 mole % of the amount of detergent, relative to the total amount of detergent present. The overbased metal salt of a carboxylate-containing detergent may also include, for example, less than 50 mole % alkyl phenols, relative to the total amount of detergent present, for example less than 35 mole %, less than 25 mole %, less than 20 mole %, less than 10 mole %, or less than 5 mole %, for example less than 2 mole % of alkyl phenols, relative to the total amount of carboxylate-containing detergent and alkylphenols present.

Some examples of suitable overbased metal salt of a carboxylate-containing detergents that may be useful in the present invention may include those wherein the overbased metal salt of a carboxylate-containing detergent is the product of reacting an overbasing compound with a salt of at least one alkyl-substituted hydroxyaromatic carboxylic acid, wherein the salt of at least one alkylhydroxyaromatic carboxylic acid is comprised of a compound or mixture of compounds represented by the structure of Formula (I):

Formula (I)

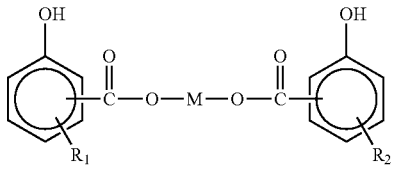

wherein i) M independently represents an alkaline earth metal, for example, magnesium, calcium, barium, and strontium;

ii) each carboxylate group independently may be in the ortho, meta or para position, or mixtures thereof, with respect to the hydroxyl group; and iii) $R_1$ and $R_2$ each independently represents a linear and/or branched alkyl group, wherein at least 50 mole % of the alkyl groups are $C_{20}$ or greater.

In one embodiment, the overbased metal salt of a carboxylate-containing detergents may comprise the product of reacting a compound or a mixture of compounds represented by the structure of Formula (I), wherein the alkyl groups, independently represented by $R_1$ and $R_2$, may be linear and/or branched alkyl groups of at least 20 carbon atoms, for example, between 20 to 40 carbon atoms or 20 to 30 carbon atoms, wherein the alkyl groups may be selected from the group consisting of $C_{20}$-$C_{22}$, $C_{20}$-$C_{24}$, $C_{20}$-$C_{28}$, $C_{20}$-$C_{30}$ and/or $C_{20}$-$C_{36}$ alkyl and mixtures thereof.

In one embodiment, the alkyl groups, independently represented by $R_1$ and $R_2$, may be derived, for example, from an oligomer of a normal alpha olefin, for example ethylene, propylene or butene. In another embodiment, the alkyl groups may contain a mixture of linear groups, a mixture of branched groups, or a mixture of linear and branched groups. Thus, the alkyl group may be a mixture of linear alkyl groups selected from the group consisting of $C_{20}$-$C_{22}$, $C_{20}$-$C_{24}$, $C_{20}$-$C_{28}$, $C_{20}$-$C_{30}$ and/or $C_{20}$-$C_{36}$ alkyl and mixtures thereof, derived for example from normal alpha olefins. These mixtures may include at least 80 mole %, for example, at least 85 mole %, 90 mole %, 93 mole %, 95 mole %, 97 mole %, 98 mole %, 99 mole %, or 100 mole % of the type of alkyl groups discussed above.

In another embodiment, the alkyl groups, independently represented by $R_1$ and $R_2$, may include those prepared by alpha olefin cuts, wherein the alkyl groups may be a mixture of alkyl groups, for example, wherein the alkyl groups are derived from the residue of normal alpha-olefins containing at least 90 mole % $C_{20}$ or greater normal alpha-olefins, such as those marketed by Chevron Phillips Chemical Company under the names Normal Alpha Olefin $C_{26}$-$C_{28}$ or Normal Alpha Olefin $C_{20}$-$C_{24}$, by British Petroleum under the name $C_{20}$-$C_{26}$ Olefin, by Shell Chimie under the name SHOP $C_{20}$-$C_{22}$, or mixtures of these cuts or olefins from these companies having from about 20 to 28 carbon atoms.

Some examples of suitable overbased metal salt of a carboxylate-containing detergents for use in the marine system oil compositions of the present invention may include, for example, overbased metal salt of a carboxylate-containing detergents wherein the detergent comprises at least one alkyl-substituted hydroxyaromatic carboxylic acid wherein the alkyl groups are $C_{20}$ or greater, and at least 50 mole % of the salt of the at least one alkyl-substituted hydroxyaromatic carboxylic acid is included as the structure of Formula (I), for example, at least 55 mole %, at least 60 mole %, at least 65 mole %, at least 75 mole %, at least 80 mole %, at least 85 mole %, at least 90 mole %, at least 92 mole %, at least 94 mole %, at least 95 mole %, at least 96 mole %, at least 97 mole %, at least 98 mole %, at least 99 mole %, or even where all of the all of the detergent is represented by the structure of Formula (I).

In one embodiment, the overbased metal salt of a carboxylate-containing detergents may include those comprising mixtures of detergents represented by the structure of Formula (I), for example, a mixture of at least 1 or more detergents represented by the structure of Formula (I), wherein the carboxylate groups of the mixture of detergents represented by the structure of Formula (I) may be predominately in the para position, with respect to the hydroxyl group, for example, at least 50%, at least 60%, at least 70%, at least 80%, at least 90% or at least 95% of the carboxylate groups of the mixture of detergents represented by the structure of Formula (I) may be in the para position, with respect to the hydroxyl group.

Some examples of suitable overbased metal salt of a carboxylate-containing detergents for use in the marine system oil compositions of the present invention may include, for example, overbased metal salt of a carboxylate-containing detergents having a TBN of greater than 100, for example between 100 and 450, between 100 and 400, or between 125 and 375, and will generally have less than 3 volume % crude sediment, for example less than 2 volume % or less than 1 volume % crude sediment. Suitable overbased metal salt of a carboxylate-containing detergents may include high overbased or middle overbased detergents. For example, high overbased metal salt of a carboxylate-containing detergents include, for example, those having a TBN of greater than 250, for example, between 250 and 450, between 300 and 400, or between 325 and 375, and will generally have less than 3 volume % crude sediment, for example, less than 2 volume % or less than 1 volume % crude sediment; and middle overbased metal salt of a carboxylate-containing detergents include, for example, those having a TBN between 100 and 250, for example, between 100 and 200, or between 125 and 175, and will generally have less than 3 volume % crude sediment, for example, have less than 2 volume %, less than 1 volume % or less than 0.5 volume % crude sediment.

In another embodiment, the present invention relates to a process of preparing an overbased metal salt of a carboxylate-containing detergent. For example, the process of preparing an overbased metal salt of a carboxylate-containing detergent, comprises: a) reacting an alkyl-substituted phenol (or alkylphenol), as described above, with an alkali metal base to produce an alkali metal alkyl-substituted phenate; b) carboxylating the alkali metal alkyl-substituted phenate obtained in step a) with a carboxylating agent, for example, carbon dioxide, to produce an alkali metal alkyl-substituted hydroxybenzoate; c) acidifying the alkali metal alkyl-substituted hydroxybenzoate with an aqueous solution of an acid strong enough to produce an alkyl-substituted hydroxybenzoic acid; and d) neutralizing or overbasing the alkyl-substituted hydroxyaromatic carboxylic acid. In a preferred embodiment overbasing is done by mixing the alkyl-substituted hydroxyaromatic carboxylic acid obtained in step c) with at least one carboxylic acid having from about one to four carbon atoms; e) neutralizing the mixture of alkyl-substituted hydroxyaromatic carboxylic acid and the at least one carboxylic acid from step d) with a metal base (for example, an alkaline earth metal base, such as calcium hydroxide) and at least one solvent selected from the group consisting of aromatic hydrocarbons, aliphatic hydrocarbons, monoalcohols, and mixtures thereof, to form the metal salt of the alkyl-substituted hydroxyaromatic carboxylic acid and at least one metal carboxylic acid salt. The neutralized mixture is then overbased by introducing a molar excess of a metal base (for example, the same metal base as in step e) or any other an alkaline earth metal base, e.g., lime) and at least one acidic overbasing material (e.g., carbon dioxide and/or boric acid) in the presence of the at least one metal carboxylic acid salt from step e) and a solvent selected from the group consisting of aromatic hydrocarbons, aliphatic hydrocarbons, monoalcohols, and mixtures thereof.

In another embodiment, the process of preparing an overbased metal salt of a carboxylate-containing detergent, comprises: a) reacting an alkyl-substituted phenol (or alkylphenol), as described above, with an alkali metal base to produce an alkali metal alkyl-substituted phenate; b) carboxylating the alkali metal alkyl-substituted phenate obtained in step a) with a carboxylating agent, for example, carbon dioxide, to produce an alkali metal alkyl-substituted hydroxybenzoate; c) acidifying the alkali metal alkyl-substituted hydroxybenzoate with an aqueous solution of an acid strong enough to produce an alkyl-substituted hydroxybenzoic acid; and d) mixing the alkyl-substituted hydroxyaromatic carboxylic acid with at least one carboxylic acid having from about one to four carbon atoms; e) neutralizing the mixture of alkyl-substituted hydroxyaromatic carboxylic acid and the at least one carboxylic acid with a metal base (for example, an alkaline earth metal base, such as calcium hydroxide) and at least one solvent selected from the group consisting of aromatic hydrocarbons, aliphatic hydrocarbons, monoalcohols, and mixtures thereof, to form the metal salt of the alkyl-substituted hydroxyaromatic carboxylic acid and at least one metal carboxylic acid salt, and f) overbasing the metal salt of the alkyl-substituted hydroxyaromatic carboxylic acid and at least one metal carboxylic acid salt by introducing a molar excess of a metal base (for example, the same metal base as in step e) or any other an alkaline earth metal base, e.g., lime) and at least one acidic overbasing material (e.g., carbon dioxide and/or boric acid) in the presence of the at least one metal carboxylic acid salt from step e) and a solvent selected from the group consisting of aromatic hydrocarbons, aliphatic hydrocarbons, monoalcohols, and mixtures thereof.

In another embodiment, the process of preparing an overbased metal salt of a carboxylate-containing detergent, comprises: a) reacting an alkyl-substituted phenol (or alkylphenol), as described above, with an alkali metal base to produce an alkali metal alkyl-substituted phenate; b) carboxylating the alkali metal alkyl-substituted phenate obtained in step a) with an acidic overbasing material, for example, carbon dioxide, to produce an alkali metal alkyl-substituted hydroxybenzoate; c) acidifying the alkali metal alkyl-substituted hydroxybenzoate with an aqueous solution of an acid strong enough to produce an alkyl-substituted hydroxybenzoic acid; d) neutralizing the alkyl-substituted hydroxybenzoic acid with a molar excess of an alkaline earth metal base, for example calcium hydroxide, and at least one solvent selected from the group consisting of aromatic hydrocarbons, aliphatic hydrocarbons; monoalcohols, and mixtures thereof to form an alkaline earth metal alkyl-substituted hydroxybenzoate; e) mixing the alkaline earth metal alkyl-substituted hydroxybenzoate and alkaline earth metal base from step d) with at least one carboxylic acid having from about one to four carbon atoms in the presence of a solvent selected from the group consisting of aromatic hydrocarbons, aliphatic hydrocarbons, monoalcohols, and mixtures thereof to form a mixture of alkaline earth metal alkyl-substituted hydroxybenzoate and at least one alkaline earth metal carboxylic acid salt; and f) overbasing the alkaline earth metal alkyl-substituted hydroxybenzoate from step e) with a molar excess of an alkaline earth metal base (for example, the same metal base as in step d) or any other an alkaline earth metal base, e.g., lime) and at least one acidic overbasing material (e.g., carbon dioxide and/or boric acid) in the presence of the at least one alkaline earth metal carboxylic acid salt from step e) and a solvent selected from the group consisting of aromatic hydrocarbons, aliphatic hydrocarbons, monoalcohols, and mixtures thereof.

In another embodiment of the invention, the amount of overbased metal salt of a carboxylate-containing detergent present in the marine system oil composition comprises between 0.1 wt. % and 35 wt. %, relative to the total weight of the system oil composition, for example, less than 35 wt. %, or for example, between 0.25 wt. % and 34 wt. %, between 0.5 wt. % and 33 wt. %, between 0.75 wt. % and 32 wt. %, between 1 wt. % and 31 wt. %, between 1.25 wt. % and 30 wt. %, between 1.5 wt. % and 29 wt. %, between 1.75 wt. % and 28 wt. %, between 2 wt. % and 27 wt. %, between 2.25 wt. % and 26 wt. %, between 2.5 wt. % and 25 wt. %, between 0.25 wt. % and 25 wt. %, between 2 wt. % and 30 wt. %, 3 wt. % and 25 wt. %, 4 wt. % and 25 wt. %, between 0.1 wt. % and 20 wt. %, between 0.5 wt. % and 20 wt. %, between 1 wt. % and 20 wt. %, between 2.5 wt. % and 20 wt. %, 5 wt. % and 20 wt. %, 6 wt. % and 20 wt. %, between 0.1 wt. % and 10 wt. %, between 0.46 wt. % and 10 wt. %, 1 wt. % and 10 wt. %, between 0.1 wt. % and 5 wt. %, between 0.25 wt. % and 5 wt. %, between 0.5 wt. % and 5 wt. %, between 1 wt. % and 5 wt. %, between 0.1 wt. % and 15 wt. %, between 0.5 wt. % and 15 wt. %, 1 wt. % and 15 wt. %, 5 wt. % and 15 wt. %, 10 wt. % and 15 wt. %, 10 wt. % and 35 wt. %, 10 wt. % and 30 wt. %, 10 wt. % and 25 wt. %, 10 wt. % and 20 wt. %, 10 wt. % and 15 wt. %, 15 wt. % and 35 wt. %, 15 wt. % and 25 wt. %, or between 15 wt. % and 35 wt. %, relative to the total weight of the system oil composition.

In another embodiment, the overbased metal salt of a carboxylate-containing detergent may be an overbased calcium salt of an alkyl hydroxyaromatic carboxylic acid prepared, for example, according to the method described in Example 1 of U.S. Patent Publication No. 2007/0027043, the contents of which are incorporated herein by reference in their entirety.

In another embodiment, a marine system oil composition may comprise more than one suitable detergent, for example, two or more, three or more, or four or more suitable detergents. For example, the suitable detergent may comprise any of the overbased metal salt of a carboxylate-containing detergents discussed above, a neutral metal salt of a carboxylate-containing detergent, or a combination or mixture thereof.

Other Additive Components

A dispersant functions to suspend insoluble contaminants in a lubricating oil, thereby keeping surfaces contacting the lubricating oil clean. Dispersants may also function to reduce changes in lubricating oil viscosity by preventing the growth of large contaminant particles in a lubricating oil.

Dispersants may, for example, contain at least one high number-average molecular weight hydrocarbon group; at least one polar group; and at least one linking group to connect the polar and nonpolar groups. Dispersants are typically metal-free, generally containing only carbon, hydrogen, nitrogen and oxygen, and sometimes containing boron.

The high number-average molecular weight hydrocarbon group in the dispersant is generally a polyolefin, such as a polyethylene group, an olefin copolymer such as an ethylene-propylene copolymer, a polybutene polymer, or a polyisobutene polymer. In another embodiment, the hydrocarbon group may be a polyisobutene polymer, for example, a polyisobutene polymer containing a high proportion of methylvinylidene olefin groups, such as at least 70 mole % methylvinylidene polyisobutene, or at least at least 80 mole % methylvinylidene. Such materials are commercially available from e.g. BASF as Glissopal® polyisobutene.

The number average molecular weight of the hydrocarbon group is at least 500, preferably at least 700 Daltons. The number average molecular weight for a hydrocarbon group is less than about 5000 Daltons, preferably less than 3000. Ranges for the molecular weight can be between 500 and 5000, such as about 600-2800, about 700-2700, about 800-2600, about 900-2500, about 1000-2400, about 1100-2300, about 1200-2200, about 1300-2100, or even about 1400-2000. In another embodiment, the hydrocarbon group may include a high methylvinylidene polyisobutene with a molecular weight of between 1000 and 2500.

The polar group is generally a polar low molecular weight compound that is attracted to the surface of a contaminant particle. Common polar groups are amines and alcohols, especially polyamines and polyalcohols. In another embodiment, the polyamines may include the polyalkylene polyamines, for example, diethylene triamine, triethylene polyamine, and the like. In another embodiment, the polyalkylene polyamines may include triethylene tetramine, tetraethylene pentamine, and the so-called "heavy polyamines", which are bottoms products of distillation of lighter polyalkylene polyamines, and may also include mixtures of polyamines.

The linking group may be any suitable linking group that connects polar compound(s) to hydrocarbon groups. In another embodiment, the linking groups may include succinimide, succinate ester, and phenolic groups. Commonly the linking group is first attached to the hydrocarbon group.

Dispersants that may be used in the marine system oil composition of the present invention may be any suitable dispersant or mixture of multiple dispersants for use in a lubricating oil. In one embodiment of the present invention, the dispersant may include an ashless dispersant, such as an ashless dispersant that comprises an alkenyl- or alkyl-succinimide or a derivative thereof, such as a polyalkylene succinimide (preferably, polyisobutene succinimide).

In another embodiment of the present invention, the dispersant may include an alkali metal or mixed alkali metal, alkaline earth metal borate, dispersion of hydrated alkali metal borate, dispersion of alkaline-earth metal borate, polyamide ashless dispersant, benzylamine, Mannich type dispersant, phosphorus-containing dispersant, or combination or mixture thereof. These and other suitable dispersants have been described in Morier et al., "Chemistry and Technology of Lubricants," 2nd Edition, London, Springer, Chapter 3, pages 86-90 (1996); and Leslie R. Rudnick, "Lubricant Additives: Chemistry and Applications," New York, Marcel Dekker, Chapter 5, pages 137-170 (2003), both of which are incorporated herein by reference in their entirety.

In one embodiment of the present invention, the dispersant may include a succinimide or a derivative thereof. In another embodiment, the dispersant may include a succinimide or derivative thereof which is obtained by reaction of a polybutenylsuccinic anhydride and a polyamine. In yet another embodiment, the dispersant may include a succinimide or derivative thereof which is obtained by reaction of a polybutenylsuccinic anhydride and a polyamine, wherein the polybutenylsuccinic anhydride is produced from polybutene and maleic anhydride (such as by a thermal reaction method using neither chlorine nor a chlorine atom-containing compound).

In another embodiment of the present invention, the dispersant may include a succinimide reaction product of the condensation reaction between polyisobutenyl succinic anhydride (PIBSA) and one or more alkylene polyamines. The PIBSA, in this embodiment, can be the thermal reaction product of high methylvinylidene polyisobutene (PIB) and maleic anhydride.

In another embodiment, the dispersant is a primarily bis-succinimide reaction product derived from PIB having a number average molecular weight (Mn) of about 500-3000, such as about 600-2800, about 700-2700, about 800-2600, about 900-2500, about 1000-2400, about 1100-2300, about 1200-2200, about 1300-2100, or even about 1400-2000.

In another embodiment, the dispersant may include a primarily bis-succinimide reaction product derived from PIB having a Mn of at least about 600, at least about 800, at least about 1000, at least about 1100, at least about 1200, at least about 1300, at least about 1400, at least about 1500, at least about 1600, at least about 1700, at least about 1800, at least about 1900, at least about 2000, at least about 2100, at least about 2200, at least about 2300, at least about 2400, at least about 2500, at least about 2600, at least about 2700, at least about 2800, at least about 2900, at least about 3000.

In one embodiment, for example, the dispersant may include a primarily bis-succinimide reaction product derived from 1000 Mn PIB, which succinimide in another embodiment is subsequently borated to achieve a boron concentration of about 0.1-3 wt. % (such as about 1-2 wt. %, such as 1.2 wt. %) in the succinimide.

In another embodiment, the dispersant may include a primarily bis-succinimide reaction product derived from 1300 Mn PIB, which succinimide in another embodiment is subsequently borated to achieve a boron concentration of about 0.1-3 wt. % (such as about 1-2 wt. %, such as 1.2 wt. %) in the succinimide. In another embodiment, the dispersant may include a primarily bis-succinimide reaction product derived from 2300 Mn PIB, which succinimide in another embodiment is subsequently reacted with ethylene carbonate.

In another embodiment, the dispersant may include a succinimide prepared by the reaction of a high molecular weight alkenyl- or alkyl-substituted succinic anhydride and a polyalkylene polyamine having 4 to 10 nitrogen atoms (average value), preferably 5 to 7 nitrogen atoms (average value) per mole. The alkenyl or alkyl group of the alkenyl or alkyl succinimide compound, in this regard, can be derived from a polybutene having a number average molecular weight of about 900-3000, such as about 1000-2500, about 1200-2300, or even about 1400-2100. In some embodiments, the reaction between polybutene and maleic anhydride for the preparation of polybutenyl succinic anhydride can be performed by a chlorination process using chlorine. Accordingly, in some embodiments, the resulting polybutenyl succinic anhydride as well as a polybutenyl succinimide produced from the polybutenyl succinic anhydride has a chlorine content in the range of approximately 2,000 to 3,000 ppm (wt). In contrast, a thermal process using no chlorine gives a polybutenyl succinic anhydride and a polybutenyl succinimide having a chlorine content in a range of such as less than 30 ppm (wt). Therefore, a succinimide derived from a succinic anhydride produced by the thermal process is preferred, in some embodiments, due to the smaller chlorine content in the lubricating oil composition.

In another embodiment, the dispersant may comprise a modified alkenyl- or alkyl-succinimide which is after-treated with a compound selected from a boric acid, an alcohol, an aldehyde, a ketone, an alkylphenol, a cyclic carbonate (e.g., ethylene carbonate), an organic acid, a succinamide, a succinate ester, a succinate ester-amide, pentaerythritol, phenate-salicylate and their post-treated analogs or the like, or combinations or mixtures thereof. Preferable modified succinimides are borated alkenyl- or alkyl-succinimides, such as alkenyl- or alkyl-succinimides which are after-treated with boric acid or a boron-containing compound. In another embodiment, the dispersant comprises alkenyl- or alkyl-succinimide that has not been after- or post-treated.

Other dispersants which may be employed in the presently claimed invention, include but are not limited to, esters of polyalcohols and polyisobutenyl succinic anhydride, phenate-salicylates and their post treated analogs, alkali metal or mixed alkali metal, alkaline earth metal borates, dispersions of hydrated alkali metal borates, dispersions of alkaline-earth metal borates, polyamide ashless dispersants and the like or mixtures of such dispersants.

The dispersant additive ("dispersant") can be in any suitable form. In one embodiment, the dispersant is mixed or blended in the marine system oil composition in the form of a concentrate comprising any suitable process or diluent oil (such as any Group I oil, Group II oil, or combination or mixture thereof) and the dispersant. In one embodiment, the process or diluent oil is an oil that is different from the base oil (e.g., Group I base oil) of the marine system oil composition, such as a different Group I base oil, a Group II base oil, or a mixture or combination thereof. In another embodiment, the process or diluent oil is an oil that is the same as the base oil (e.g., Group I base oil) of the marine system oil composition.

The concentration of the one or more dispersants within the marine system oil composition (or concentrate) of the present invention may be at least about 1.0 wt. %, relative to the total weight of the system oil composition, such as at least 1.25 wt. %, at least 1.5 wt. %, at least 1.75 wt. %, at least 2.0 wt. %, or even at least 2.5 wt. %. The concentration of the one or more dispersants within the marine system oil additive composition on an actives basis is at least about 10 wt. %, more preferably at least 12.5 wt. %, at least 15 wt. %, at least 17.5 wt. %, at least 20 wt. %, or even at least 25 wt. %.

The following additive components are examples of components that may be included in the marine system oil composition (or concentrate) of the present invention. These examples of additives may be present in any suitable amount to achieve the desired function, for example, additives may be present in the marine system oil composition (or concentrate) of the present invention in an amount of from 0.1 to 20 wt. %, relative to the total weight of the system oil composition, such as greater than 0.5 wt. %, 1 wt. %, 1.5 wt. %, 2 wt. %, or greater than 3 wt. %.

Wear Inhibitors

Some additives function to provide many functionalities simultaneously. In another embodiment, the wear inhibitors that may be useful in the marine system oil composition of the present invention may include zinc aryl and alkyl dithiophosphates (ZnDTP), which can simultaneously provide antiwear, extreme pressure, and oxidation inhibition. For example, the wear inhibitor may be an alkaryl, primary alkyl, or a secondary alkyl zinc dithiophosphate, such as a primary alkyl zinc dithiophosphate.

Anti-Oxidants

Anti oxidants reduce the tendency of oils to deteriorate upon exposure to oxygen and heat. This deterioration is evidenced by the formation of sludge and varnish like deposits, an increase in viscosity of the oil, and by an increase in corrosion or wear. Examples of anti-oxidants that may be useful in the marine system oil composition of an embodiment of the present invention include phenol type (phenolic) oxidation inhibitors, such as 2,6-di-tert-butylphenol, 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis (3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-1-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-10-butylbenzyl)-sulfide, and bis(3,5-di-tert-butyl-4-hydroxybenzyl). Diphenylamine type oxidation inhibitors include, but are not limited to, alkylated diphenylamine, phenyl-alpha-naphthylamine, and alkylated-alpha-naphthylamine. Sulfur-containing oxidation inhibitors include ashless sulfides and polysulfides, metal dithiocarbamate (e.g., zinc dithiocarbamate), and 15-methylenebis-(dibutyldithiocarbamate). Phosphorus compounds especially the alkyl phosphites, sulfur-phosphorus compounds, and copper compounds may also be used as antioxidants.

Anti Wear Inhibitors

Anti-wear agents reduce wear of moving metallic parts in conditions of continuous and moderate loads. Examples of anti-wear inhibitors that may be useful in the marine system oil composition of an embodiment of the present invention include phosphates and thiophosphates and salts thereof, carbamates, esters, and molybdenum complexes. Especially preferred antiwear compounds are the amine phosphates.

Rust Inhibitors (Anti Rust Agents)

Rust inhibitors correct against the corrosion of ferrous metals. Examples of rust inhibitors that may be useful in the marine system oil composition of an embodiment of the present invention include (a) Nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol monooleate, and polyethylene glycol monooleate; and (b) miscellaneous other compounds such as stearic acid and other fatty acids, dicarboxylic acids, metal soaps, fatty acid amine salts, metal salts of heavy sulfonic acid, partial carboxylic acid ester of polyhydric alcohol, and phosphoric ester.

Demulsifiers

Demulsifiers promote the separation of oil from water which may come into contact with the oil through contamination. Examples of demulsifiers that may be useful in the marine system oil composition of an embodiment of the present invention include addition product of alkylphenol and ethylene oxide, polyoxyethylene alkyl ether, and polyoxyethylene sorbitan ester.

Extreme Pressure Agents (EP Agents)

Extreme pressure agents reduce wear of moving metallic parts in conditions of high loads. Examples of extreme pressure agents that may be useful in the marine system oil composition of an embodiment of the present invention include sulfurized olefins, zinc dialky 1 dithiophosphate (primary alkyl, secondary alkyl, and aryl type), diphenyl sulfide, methyl trichlorostearate, chlorinated naphthalene, fluoroalkylpolysiloxane, lead naphthenate, neutralized or partially neutralized phosphates, dithiophosphates, and sulfur free phosphates.

Low Melting Point Organic Friction Modifiers

Friction modifiers with melting points less than 30° C. may also be employed in this invention. Examples of low melting point organic friction modifiers that may be useful in the marine system oil composition of an embodiment of the present invention include certain fatty alcohols, fatty acids, fatty acid partial esters, fatty acid amides, alkylamines, alkyl amine alkoxylates, and borated versions of the preceding. Other friction modifiers include the metallorganic friction modifiers such as sulfurized oxymolybdenum dithiocarbamate, sulfurized oxymolybdenum organo phosphorodithioate, oxymolybdenum monoglyceride, oxymolybdenum diethylate amide, amine molybdenum complex compound, and sulfur containing molybdenum complex compound. Copper-containing friction modifiers may also be used.

Viscosity Index Improvers

Viscosity index improvers are used to increase the viscosity index of lubricating oils, thereby reducing the viscosity decrease of an oil with increasing temperature. Examples of viscosity index improvers that may be useful in the marine system oil composition of an embodiment of the present invention include polymethacrylate polymers, ethylene propylene copolymers, styrene isoprene copolymers, hydrated styrene isoprene copolymers, and polyisobutylene are all used as viscosity index improvers. Particularly preferred viscosity index improvers are the polymethacrylate polymers. Nitrogen- and oxygen-functionalized polymers, the so-called dispersant viscosity index improvers, may also be used.

Pour Point Depressants

Pour point depressants lower the temperature at which waxes precipitate out of lubricating oils, thus extending the temperature range in which the lubricating oil can operate before oil flow is impeded. Examples of pour point depressants that may be useful in the marine system oil composition of an embodiment of the present invention include polymethyl methacrylates, ester-olefin copolymers especially ethylene vinyl acetate copolymers, and others Foam Inhibitors Foam inhibitors work to accelerate the release of gas entrained in a lubricant during operation. Examples of foam inhibitors that may be useful in the marine system oil composition of an embodiment of the present invention include alkyl methacrylate polymers and dimethylsiloxane polymers.

Metal Deactivators

Metal deactivators hinder corrosion of metal surfaces, and chelate metal ions in solution in lubricating oils, thereby reducing oxidation caused by the catalytic effect of the metal ion. Examples of metal deactivators that may be useful in the marine system oil composition of an embodiment of the present invention include salicylidene propylenediamine, triazole derivatives, mercaptobenzothiazoles, thiadiazole derivatives, and mercaptobenzimidazoles.

Other Metal Detergents

Examples of other metal detergents that may be useful in the marine system oil composition of an embodiment of the present invention include sulfurized or unsulfurized alkyl or alkenyl phenates, alkyl or alkenyl aromatic sulfonates, calcium sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multi-acid, and chemical and physical mixtures thereof. Other metal detergents that may be used in the marine system oil compositions of the present invention include, for example, metal sulfonates, phenates, salicylates, phosphonates, thiophosphonates and combinations thereof The metal can be any metal suitable for making sulfonate, phenate, salicylate or phosphonate detergents, for example, the metal is an alkali metal, alkaline metal and/or a transition metal. In other embodiments, the metal is Ca, Mg, Ba, K, Na, Li or the like.

In another embodiment, the marine system oil composition may additionally comprise a carboxylate-containing detergent, wherein the detergent comprises a multi-surfactant unsulfurized, non-carbonated, non-overbased, carboxylate-containing additive prepared, for example, according to the method described in Example 1 of U.S. Patent Application Publication No. 2004/0235686, the contents of which are incorporated herein by reference in their entirety.

In another embodiment, the marine system oil composition is free of detergent that does not contain an overbased metal salt of a carboxylate-containing detergent. In another embodiment, the marine system oil composition is free of metal salts of a sulfonic acid. In another embodiment, the only alkylphenol detergents present in the marine system oil composition are those alkylphenols that are introduced as part of the overbased metal salt of a carboxylate-containing detergent. In another embodiment, the marine system oil composition is free of salicylate-containing detergents. In another embodiment, the detergent of the marine system oil composition is free of alkyl phenates.

Marine System Oil Properties

The marine system oil composition of the present invention may have one or more of the following properties:

(a) a viscosity less than 19 cSt at 100° C., for example, in the range of between 10-18 cSt, 10-13 cSt, 11-12 cSt, 9-14 cSt, 8-15 cSt, or in the range of between 10-15 cSt;

(b) a SAE viscosity grade as defined by SAE standard J300 of less than or equal to 40, for example, in the range of between 30-40, between 20-40, or equal to 30;

(c) a viscosity of less than 138 cSt at 40° C., for example, in the range of between 100-135 cSt, 90-115 cSt, or in the range of between 95-105 cSt;

(d) a viscosity index of greater than or equal to 90, for example, greater than 90, greater than 95, or greater than 100;

(e) a flash point (closed cup) greater than 220° C., for example, in the range of between 220-230° C. or in the range of between 220-235° C.;

(f) a pour point of less than −10° C., for example, less than −12° C., −13° C., −14° C., −15° C., −16° C., −17° C., or less than −18° C.;

(g) a TBN in the range of between 3.5 and 20, for example, in the range of between 3.5 and 18, between 3.5 and 14, between 3.5 and 10, between 3.5 and 9, between 3.5 and 7, between 3.5 and 6, between 3.5 and 5, between 4 and 16, between 4 and 12, between 4 and 10, between 4 and 8, between 4 and 7, between 4 and 6, between 4 and 5, between 4.5 and 15, between 5 and 13, between 5 and 9, between 5 and 8, between 5 and 7, between 5.5 and 11, between 6 and 10, between 7 and 12, or in the range of between 10 and 20; and (h) a soap content greater than 6 millimoles surfactant/kg system oil composition (mmol/kg); for example greater than 7 mmol/kg; 8 mmol/kg; 9 mmol/kg or 10 mmol/kg.

Marine System Oil Additive or Concentrate

In another embodiment of the invention, a marine system oil composition is provided by adding a marine system oil additive package or additive concentrate comprising an overbased metal salt of a carboxylate-containing detergent, as described above, and, typically, a base oil as described above, with or without additional additives. The marine system oil additive package or additive concentrate would comprise a greater wt. % of the overbased metal salt of a carboxylate-containing detergent than typically present in a marine system oil composition, for example greater than 35 wt. %, based on the total weight of the concentrate composition, for example between 40 wt. % and 90 wt. %, between 50 wt. % and 80 wt. %, or between 60 wt. % and 75 wt. %. The concentrate can then be mixed in with a base oil, and optionally other components, to form a marine system oil composition having a TBN in the range of between 3.5 and 20, for example, in the range of between 3.5 and 18, between 3.5 and 14, between 3.5 and 10, between 3.5 and 9, between 3.5 and 7, between 3.5 and 6, between 3.5 and 5, between 4 and 16, between 4 and 12, between 4 and 10, between 4 and 8, between 4 and 7, between 4 and 6, between 4 and 5, between 4.5 and 15, between 5 and 13, between 5 and 9, between 5 and 8, between 5 and 7, between 5.5 and 11, between 6 and 10, between 7 and 12, or in the range of between 10 and 20.

Sample Preparation of an Overbased Metal Salt of a Carboxylate-Containing Detergent Having a TBN of 350

This example is excerpted from U.S. Patent Publication No. US 2007/0027043, the entirety of which is hereby incorporated by reference.

A) Formation of the Alkali Metal Base Alkylphenate:

Alkylphenols (1000 g) prepared from mixtures of linear normal alpha olefins ($C_{20}$-$C_{28}$ alpha olefins from Chevron Phillips Chemical Company), xylene (500 g) was placed in a reactor and heated to 60° C. over a period of 15 minutes then 290 g of an aqueous solution at 45% KOH (2.325 mole) and 0.2 g of a defoamer called Rhodorsil 47V300 (commercialized by Rhodia) were added. The reactor was then heated further to 145° C. over a period of 2 hours while gradually decreasing the pressure from atmospheric pressure (1013 mbar absolute $-1\times10^5$ Pa) to 800 mbar absolute ($8\times10^4$ Pa). Under these conditions, reflux begins and was maintained for 3 hours. During this period, approximately 179 mL of water was removed.

B) Carboxylation:

The reactor containing the alkali metal alkylphenate from step A) was allowed to cool to 140° C. The reactor was then pressurized with $CO_2$ at 4 bar ($4\times10^5$ Pa) (absolute pressure) and maintained under these conditions for 4 hours. At the end of this period, $CO_2$ was vacated to allow the reactor to reach atmospheric pressure. At this step, 82 g of $CO_2$ was incorporated to form the alkali metal alkyl hydroxybenzoate.

C) Acidification:

The alkali metal alkylhydroxybenzoate from step B) was reacted with a 20 molar % excess of a 10% aqueous solution of sulfuric acid to convert it to an alkylhydroxybenzoic acid as follows.

A mixture of 140 g of sulfuric acid at 98% and 1257 g of water in order to obtain 1397 g of a solution of sulfuric acid diluted at 10% was placed in a 6 liter reactor and heated to 50° C. under agitation at 250 rpm; the alkyhydroxybenzoate from step B) and xylene (1500 g) were loaded over a period of 30 minutes. Xylene assisted in phase separation. The reactor was heated to and maintained at 60° C. to 65° C. for 2 hours with continued agitation at 250 rpm. At the end of this period, agitation was stopped, but the reactor was maintained at 60° C. to 65° C. for 2 hours to allow the phase separation to occur. Upon phase separation, the lower aqueous phase which contains water and potassium sulfate was decanted. The upper organic phase containing the alkylhydroxybenzoic acid and xylene were collected for the following step. The concentration of alkylhydroxybenzoic acid was determined as an equivalent number of mg of KOH/g, also known as the Total Acid Number (T.A.N.), as described in ASTM D664.

D) Neutralization:

The upper organic phase (3045 g) containing the alkylhydroxybenzoic acid from step C) (having a T.A.N. of 35 mg KOH/g) was loaded under agitation into a reactor over a 10 minute period. Then a slurry of methanol (573 g), lime (573 g) and xylene (735 g) was introduced. Due to the exothermic reaction, temperature increased from about 20° C. to 28° C. Once the slurry was added, the reactor was heated to 40° C. over a period of 30 minutes and a mixture of formic acid (14.65 g):acetic acid (14.65 g) was added and allowed to react with the contents in the reactor. After a period of 5 minutes, the reactor was cooled to 30° C. over a period of 30 minutes.

E) Overbasing:

Once the temperature of the reactor had cooled to 30° C., $CO_2$ (70.3 g) was introduced into the reactor at a flow rate of 1.37 g/minute over a period of 15 minutes then 171 g of $CO_2$ was introduced at a flow rate of 1.62 g/minute over a period of 105 minutes. A slurry of methanol (109 g), lime (109 g) and xylene (145 g) was added. Then additional $CO_2$ (128.4 g) was added over a period of 79 minutes at a flow rate of 1.62 g/minute. The reaction yielded an overbased alkaline earth metal alkylhydroxybenzoate. The percentage of crude sediment 1.2 volume % was determined at this step following the ASTM D2273 method.

F) Predistillation, Centrifugation, and Final Distillation:

The mixture contained within the reactor was taken in stages to a temperature between 65° C. to 128° C. over a period of 110 minutes. This procedure removed methanol, water and a portion of the xylene. Once 128° C. was reached, diluent oil (775 g) was added. Crude sediment was then measured. The amount of crude sediment in the overbased alkaline earth metal alkylhydroxybenzoate was very low (1.2 volume %).

The reaction mixture was centrifuged to remove crude sediment and then distilled at 204° C. for 10 minutes under vacuum at 50 mbar absolute ($50\times10^2$ Pa) to remove the remaining xylene to yield the overbased alkaline earth metal alkylhydroxybenzoate having a TBN of 350.

EXAMPLES

The following examples are given as particular embodiments of the invention and to demonstrate the advantages thereof. It is understood that the examples are given by way of illustration and are not intended to limit the specification or the claims that follow in any manner.

To demonstrate the superior performance of the marine system oil compositions of the present invention, the compositions which contained overbased metal salt of a carboxylate-containing detergents were compared to marine system oil compositions containing overbased metal salt of a salicylate-containing detergents. The oil compositions were evaluated using the Black Sludge Deposit (BSD) Test, MAO 62 Dispersion Test, the Differential Scanning Calorimetry (DSC) Oxidation Test, and the Modified Institute of Petroleum 48 (MIP-48) Test.

The following components were used in the examples described below:

Base Oils

Group I:

ExxonMobil CORE® 600N: Group I-based lubricating oil was ExxonMobil CORE® 600N basestock, available from ExxonMobil (Irving, Tex.).

ExxonMobil CORE® 150N: Group I-based lubricating oil was ExxonMobil CORE® 150N basestock, available from ExxonMobil (Irving, Tex.).

Overbased Detergents

Overbased Carboxylate-Containing Detergents

Carboxylate 150: An oil additive concentrate of an overbased calcium alkylhydroxybenzoate detergent having a TBN of 150, comprising a calcium salt of an alkyl-substituted hydroxybenzoic acid, wherein the detergent was derived from an alkyl-substituted hydroxyaromatic carboxylic acid wherein at least 90 mole % of the alkyl groups are $C_{20}$ or greater and the detergent contains about 5.35 wt. % Ca; prepared according to the method described in Example 3 of US Patent Application Publication No. 2007/0027043, the entirety of which is hereby incorporated by reference.

Carboxylate 350: An oil additive concentrate of an overbased calcium alkylhydroxybenzoate detergent having a TBN of 350, comprising a calcium salt of an alkyl-substituted hydroxybenzoic acid, wherein the detergent was derived from an alkyl-substituted hydroxyaromatic carboxylic acid wherein at least 90 mole % of the alkyl groups are $C_{20}$ or greater and the detergent contains about 12.5 wt. % Ca; prepared according to the method described in Example 1 of US Patent Application Publication No. 2007/0027043, the entirety of which is hereby incorporated by reference.

Overbased Salicylate-Containing Detergents

Salicylate 170: A commercially available, low molecular weight, oil additive concentrate of an overbased calcium salt of a salicylate-containing detergent having a TBN of 170, comprising a calcium salt of a $C_{14}$-$C_{18}$ salicylate, wherein the detergent was derived from an alkyl-substituted hydroxybenzoic acid wherein greater than 95 mole % of the alkyl groups are $C_{14}$-$C_{18}$ and the detergent contains about 6 wt. % Ca.

Salicylate 280: A commercially available, low molecular weight, oil additive concentrate of an overbased calcium salt of a salicylate-containing detergent having a TBN of 280, comprising a calcium salt of a $C_{14}$-$C_{18}$ salicylate, wherein the detergent was derived from an alkyl-substituted hydroxybenzoic acid wherein greater than 95 mole % of the alkyl groups are $C_{14}$-$C_{18}$ and the detergent contains about 10 wt. % Ca.

Anti-Wear ZnDTP Agents

ZnDTP (a): Oil additive concentrate of a primary ZnDTP derived from $C_4$/$C_5$ alcohols.

ZnDTP (b): Oil additive concentrate of secondary ZnDTP derived from a mixture of $C_4$ and $C_6$ alcohols.

ZnDTP (c): Oil additive concentrate of primary ZnDTP derived from a mixture of $C_4$ and $C_8$ alcohols.

ZnDTP (d): Oil additive concentrate of primary ZnDTP derived from 2-ethyl hexanol.

Dispersant

A bis-succinimide dispersant derived from 1000 MW polybutene and HPA/DETA.

Compositions I & II

Two sample marine system oil compositions were prepared with varying Overbased detergents. The components and amounts for preparing the sample marine system oil compositions are set forth in Table 2: Marine System Oil Compositions. The TBN of these compositions was maintained at 5 mg KOH/g and the Finished oil viscosity was maintained at 11-12 cSt at 100° C. regardless of which overbased detergent was used for the test composition.

Examples 1-3 and Comparative Examples A-C

The test results of the sample marine system oil compositions, along with the specific overbased detergent used and the soap content (mmol/kg) of these compositions are set forth in Table 3: Test Results for Marine System Oil Compositions.

TABLE 2

| MARINE SYSTEM OIL COMPOSITIONS | | | |
|---|---|---|---|
| | | Marine System Oil Composition I (wt. %) | Marine System Oil Composition II (wt. %) |
| Group I BASE OIL | ExxonMobil CORE ® 600N | 83-92 | 83-92 |
| | ExxonMobil CORE ® 150N | 3.5-12.0 | 3.5-12.0 |
| OVERBASED DETERGENTS | | (See Table 3) | (See Table 3) |
| Anti-Wear Agent | ZnDTP (a) | — | 0.25 |
| | ZnDTP (b) | 0.18 | — |
| | ZnDTP (c) | 0.07 | — |
| | ZnDTP (d) | 0.08 | — |
| Anti-Oxidant (alkylated diphenylamine) | | 0.11 | — |
| Anti-Oxidant (2,6-di-tert-butyl phenol) | | — | 0.25 |
| Demulsifier/Rust Inhibitor | | 0.05 | 0.05 |
| Dispersant | | 0.08 | — |
| Foam Inhibitor (dimethylsiloxane polymers) | | 0.003 | — |
| PROPERTIES OF MARINE SYSTEM OIL COMPOSITIONS | | | |
| TBN (mg KOH/g) (ASTM D2896) | | 5 | 5 |
| Viscosity (cSt at 100° C.) | | 11-12 | 11-12 |

TABLE 3

TEST RESULTS FOR MARINE SYSTEM OIL COMPOSITIONS

| | | OVERBASED DETERGENTS | | | BSD (200° C., 12 hours) | | | Asphaltene Dispersion | | MIP-48 (200° C.) | | DSC Oxidation |
|---|---|---|---|---|---|---|---|---|---|---|---|---|
| EXAMPLES | Marine System Oil Composition | Salicylate-Containing Detergents | Carboxylate-Containing Detergents | Soap Content (mmol/kg) | 2 wt. % HFO (mg) | 3 wt. % HFO (mg) | 4 wt. % HFO (mg) | Fresh Oil (6X) | Aged Oil (6X) | Viscosity Increase (%) | BN Depletion (%) | Oxidation Induction Time (min.) |
| Comparative A | I | Salicylate 280 | — | 5.8 | 10.1 | 23.5 | 61.3 | 189 | 155 | 40.0 | 95.0 | 19.39 |
| 1 | I | — | Carboxylate 350 | 5.7 | 57.3 | 574.0 | — | 200 | 285 | 22.3 | 76.7 | 20.99 |
| Comparative B | I | Salicylate 170 | — | 15.6 | 12.9 | 31.6 | 53.0 | 217 | 243 | 22.2 | 78.2 | 21.49 |
| 2 | I | — | Carboxylate 150 | 17.1 | 28.8 | 12.5 | 45.9 | 243 | 286 | 14.2 | 58.0 | 26.44 |
| Comparative C | II | Salicylate 170 | — | 15.2 | 15.3 | 30.5 | — | 214 | 292 | 21.0 | 77.7 | 23.65 |
| 3* | II | — | Carboxylate 350/ Carboxylate 150 | 14.4 | 6.5 | 21.6 | — | 239 | 277 | 16.1 | 72.0 | 24.22 |
| 4 | II | — | Carboxylate 150 | 18.2 | 4.0 | 6.9 | — | 239 | 235 | 11.1 | 69.7 | 25.73 |

Table Notes:
*The weight ratio of Carboxylate 350/Carboxylate 150 was 17:83 wt. %.
"—" represents no data.

Test Methods

Black Sludge Deposit (BSD) Test

This test is used to evaluate the ability of marine lubricants to cope with instable-unburned asphaltenes in the residual fuel oil. The test measures the tendency of lubricants to cause deposits on a test strip, by applying oxidative thermal strain on a mixture of heavy fuel oil and lubricant.

A sample of a marine system oil composition was mixed with a specific amount of marine residual fuel to form test mixtures. The test mixture is pumped during the test as a thin film over a metal test strip, which is controlled at test temperature (200° C.) for a period of time (12 hours). The test oil-fuel mixture is recycled into the sample vessel. After the test, the test strip is cooled and then washed and dried. The test plates are then weighed. In this manner, the weight of the deposit remaining on the test plates was measured and recorded as the change in weight of the test plate.

Asphaltene Dispersion Test

This test evaluates the ability of marine system oils to keep asphaltenic and carbonaceous materials dispersed by measuring the dispersion of oil and black matter on filter paper. Dispersions are measured on both fresh and aged oils, with different treatment heating conditions and with and without water addition.

The fresh sample consists of a mixture of a majority of fresh marine system oil, heavy fuel oil, and carbon black. The aged sample consists of a mixture of fresh marine system oil and heavy fuel oil which is aged by heating at elevated temperature under oxidizing conditions. Carbon black is added to the aged sample after the aging step.

Both fresh and aged oil samples are then subjected to three different heat treatments, both with and without water addition, making a total of six different treatments. A drop of treated sample is then placed on a piece of filter paper and developed in an incubator for 48 hours. After development, the drops form a small, dark circular sludge area surrounded by a light oil area. The diameters of the oil and sludge areas are measured and the ratio of the oil:sludge diameters calculated. The test results are reported as 6×, which is the sum of the ratio of oil:sludge diameters from the six different treatments.

Modified Institute of Petroleum 48 (MIP 48) Test

This test measures the degree of stability against oxidation-based viscosity increase of the lubricant. The test consists of a thermal and an oxidative part. During both parts of the test the test samples are heated for a period of time. In the thermal part of the test, nitrogen is passed through a heated oil sample for 24 hours and in parallel during the oxidative part of the test, air is passed through a heated oil sample for 24 hours. The two samples were then cooled, and the viscosities of the samples were determined. The BN depletion and viscosity increase of the test oil caused by oxidation are determined and corrected for the thermal effect. The oxidation-based viscosity increase for each marine system oil composition was calculated by subtracting the kinematic viscosity at 200° C. for the nitrogen-blown sample from the kinematic viscosity at 200° C. for the air-blown sample, and dividing the subtraction product by the kinematic viscosity at 200° C. for the nitrogen blown sample.

Differential Scanning Calorimeter (DSC) Test

This test is used to evaluate thin film oxidation stability of test oils, in accordance with ASTM D-6186. Heat flow to and from test oil in a sample cup is compared to a reference cup during the test. The Oxidation Onset Temperature is the temperature at which the oxidation of the test oil starts. The Oxidation Induction Time is the time at which the oxidation of the test oil starts. The oxidation reaction results in an exothermic reaction which is clearly shown by the heat flow. The Oxidation Induction Time is calculated to evaluate the thin film oxidation stability of the test oil.

All publications and patent applications mentioned in this specification are herein incorporated by reference to the same extent as if each individual publication or patent application was specifically and individually indicated to be incorporated by reference.

While preferred embodiments of the present invention have been shown and described herein, it will be obvious to those skilled in the art that such embodiments are provided by way of example only. It is intended that the following claims define the scope of the invention and that methods and structures within the scope of these claims and their equivalents be covered thereby.

What is claimed is:

1. A marine system oil composition, comprising:

a) a major amount of a base oil of lubricating viscosity; and b) a minor amount of a carboxylate-containing detergent comprising the salt of at least one alkyl-substituted hydroxyaromatic carboxylic acid prepared by the process comprising reacting a mixture containing:

i) at least one alkyl-substituted hydroxyaromatic carboxylic acid, wherein at least 50 mole % of the alkyl groups on the at least one alkyl-substituted hydroxyaromatic carboxylic acid are $C_{20}$ or greater; and ii) a base;

wherein the marine system oil composition has a TBN in the range of between 3.5 to 18.

2. The marine system oil composition of claim 1, wherein the salt of the at least one alkyl-substituted hydroxyaromatic carboxylic acid is further reacted with:

at least one overbasing compound in the presence of a further base;

to provide an overbased salt of the at least one alkyl-substituted hydroxyaromatic carboxylic acid.

3. The marine system oil composition of claim 1, wherein the mixture further contains:

at least one overbasing compound;

to provide an overbased salt of the at least one alkyl-substituted hydroxyaromatic carboxylic acid.

4. The marine system oil composition of claim 2, wherein the base and the further base are the same.

5. The marine system oil composition of claim 1, wherein the base oil comprises a group I and/or group II base oil.

6. The marine system oil composition of claim 1, wherein the carboxylate-containing detergent is present in amount of less than 35 wt. %, relative to the total weight of the system oil composition.

7. The marine system oil composition of claim 1, wherein the salt of the at least one alkyl-substituted hydroxyaromatic carboxylic acid is not overbased.

8. The marine system oil composition of claim 1, wherein the carboxylate-containing detergent is a non-overbased carboxylate-containing detergent.

9. The marine system oil composition of claim 1, wherein the alkyl-substituted hydroxyaromatic carboxylic acid is an alkyl-substituted hydroxybenzoic acid.

10. The marine system oil composition of claim 1, wherein the system oil composition has a soap content greater than 6 mmol/kg.

11. The marine system oil composition of claim 1, wherein the carboxylate-containing detergent has a TBN in the range of between 100 to 450.

12. The marine system oil composition of claim 1, wherein the base is a metal base.

13. The marine system oil composition of claim 12, wherein the metal is an alkaline earth metal.

14. The marine system oil composition of claim 13, wherein the alkaline earth metal is calcium.

15. The marine system oil composition of claim 2, wherein the at least one overbasing compound is carbon dioxide.

16. The marine system oil composition of claim 3, wherein the at least one overbasing compound is carbon dioxide.

17. The marine system oil composition of claim 2, wherein the further base comprises calcium hydroxide.

18. The marine system oil composition of claim 17, wherein the source of calcium hydroxide is lime.

19. The marine system oil composition of claim 1, wherein the salt of the at least one alkyl-substituted hydroxyaromatic carboxylic acid is the sole detergent in the composition.

20. The marine system oil composition of claim 2, wherein the overbased salt of the at least one alkyl-substituted hydroxyaromatic carboxylic acid is the sole overbased detergent in the composition.

21. The marine system oil composition of claim 3, wherein the overbased salt of the at least one alkyl-substituted hydroxyaromatic carboxylic acid is the sole overbased detergent in the composition.

22. The marine system oil composition of claim 2, wherein:

i) the overbasing compound comprises carbon dioxide; and ii) the base comprises calcium hydroxide;

to provide an overbased calcium salt of the at least one alkyl-substituted hydroxyaromatic carboxylic acid.

23. The marine system oil composition of claim 3, wherein:

i) the base comprises calcium hydroxide; and ii) the least one overbasing compound comprises carbon dioxide;

to provide an overbased calcium salt of the at least one alkyl-substituted hydroxyaromatic carboxylic acid.

24. A marine system oil additive concentrate, comprising greater than 35 wt. % of a carboxylate-containing detergent;

wherein the carboxylate-containing detergent comprises a salt of at least one alkyl-substituted hydroxyaromatic carboxylic acid prepared by a process comprising reacting a mixture containing:

i) at least one alkyl-substituted hydroxyaromatic carboxylic acid, wherein at least 50 mole % of the alkyl groups on the at least one alkyl-substituted hydroxyaromatic carboxylic acid are $C_{20}$ or greater; and ii) a base.

25. A method of providing lubrication of a crankcase in a slow speed two-stroke cross-head marine diesel engine, comprising operating the engine with the marine system oil composition of claim 1.

26. A method of making a marine system oil composition, comprising mixing together:

a) a major amount of a base oil of lubricating viscosity; and b) a minor amount of a carboxylate-containing detergent comprising the salt of at least one alkyl-substituted hydroxyaromatic carboxylic acid prepared by the process comprising reacting a mixture containing:

i) at least one alkyl-substituted hydroxyaromatic carboxylic acid, wherein at least 50 mole % of the alkyl groups on the at least one alkyl-substituted hydroxyaromatic carboxylic acid are $C_{20}$ or greater; and ii) a base;

wherein the resulting marine system oil composition has a TBN in the range of between 3.5 to 18.

* * * * *